US006957859B1

(12) United States Patent
Patus

(10) Patent No.: US 6,957,859 B1
(45) Date of Patent: Oct. 25, 2005

(54) CHAIR FOR A PERSON LIFT

(76) Inventor: Nandor Patus, 56881 Pine Rd., South Bend, IN (US) 46619

( * ) Notice: Subject to any disclaimer, the term of this patent is extended or adjusted under 35 U.S.C. 154(b) by 0 days.

(21) Appl. No.: 10/905,552

(22) Filed: Jan. 10, 2005

(51) Int. Cl.[7] ..... A47C 31/00
(52) U.S. Cl. ..... 297/217.1; 297/452.18; 5/83.1; 5/85.1
(58) Field of Search ..... 297/273, 277, 297/452.18, 217.1; 5/83.1, 88.1, 85.1, 87.1; 105/149.2, 148, 89

(56) References Cited

U.S. PATENT DOCUMENTS 669,450 A * 3/1901 Stephens ..... 5/85.1
1,709,153 A * 4/1929 Pownall ..... 5/83.1
2,688,410 A * 9/1954 Nelson ..... 212/343
3,351,959 A * 11/1967 Turpin ..... 5/83.1
3,596,612 A * 8/1971 Sowder ..... 105/149.2
3,814,022 A * 6/1974 Smith ..... 104/89
4,125,908 A 11/1978 Vail et al.
4,393,529 A 7/1983 Britz
5,379,468 A 1/1995 Cassidy et al.
5,456,655 A 10/1995 Morris
5,539,941 A 7/1996 Fuller

* cited by examiner

*Primary Examiner*—Milton Nelson, Jr.
(74) *Attorney, Agent, or Firm*—Leo H McCormick, Jr.

(57) ABSTRACT

A chair for transporting a person from a first location to a second location along a rail in response to an input provided to a control for a hoist and motorized conveyor by the person. The chair includes first and second seat portions that are pivotally attached to a frame and connected by a linkage arrangement to a lever arm. The hoist moves the chair toward a fixed surface while surrounding the person and as the person moves the lever arm from a first position, the first and second seats portions move from a vertical position to horizontal position under the person. Thereafter, the lever is locked in a fixed position and the hoist activated to raise the chair to allow the chair to be moved by the motorized conveyor along the rail.

10 Claims, 5 Drawing Sheets

CHAIR FOR A PERSON LIFT

This invention relates to a chair for use in a person transporting system that includes a hoist and conveyor whereby the person is vertically lifted from a first location and thereafter horizontally moved along a line from the first location to a second location in response to an input signal provided by the person to a control for the motor associated with the hoist and conveyor.

BACKGROUND OF THE INVENTION

Many apparatus have been disclosed for lifting a person from a bed to a wheel chair or carnage in order to transport the person from one location to another. In U.S. Pat. No. 5,539,941 a support frame is placed under the person and the frame is connected to a winding motor that lifts the frame to allow a person to be moved from a bed to a carriage while in U.S. Pat. Nos. 5,117,516 and 5,379,468 a torso support is placed on a person and in U.S. Pat. No. 4,125,908 a sling is used to provide for movement of a person from a bed. Even though the apparatus of the known prior art function in an adequate manner, persons who have the use of their motor facilities upward from their waist may desire more independence with respect to activities than is provided by such apparatus.

SUMMARY OF THE INVENTION

The present invention provides a person with sufficient arm strength and body control to independently get into a chair and control the movement of the chair along a rail from one location to a second location.

In more particular detail, the chair is attached to a motorized hoist and conveyor carried on a rail such that the person may be vertically lifted from a first location and thereafter horizontally moved from the first location to a second location in response to an input signal provided to a control for the motorized hoist and conveyor. The chair has a frame defined by a first member that is separated from a second member by first and second support members to form a rigid structure. The first support member is connected to the hoist through the center of gravity for the chair such that with a first top arm and a first bottom arm attached to the first member and a second ton arm and a second bottom arm attached to the second member and when a seat is attached to the first and second bottom arms, the seat will be located in a plane that is horizontal to the rail. The seat consisting of a first portion that is pivotally attached to a first shaft that extends through the first bottom arm on the first member of the frame and a second portion that is pivotally attached to a second shaft that extends through the second bottom arm on the second member of the frame. Each portion of the seat consists of at least first and second planks. First and second disc are attached to the second support member, with the first disc connected to an actuation shaft through a first link, to the second disc through a second link and to a first plank in the first portion of the seat through a third link while the second disc is connected to the first plank in the second portion of the seat by a fourth link. A lever is connected to the actuation shaft and is located in a rest or first position such that the first and second portions of the seat are aligned in a parallel relationship with the first and second members of the frame. When a person desires to use the chair, the person supplies an input signal to a control through which the motor for the hoist is activated to lower the chair from a first vertical position to a second vertical position such that the arms and frame surround the person. When the chair is further lowered, the second planks initially engage a fixed surface supporting the person and independently move on the fixed surface toward each other and under the person. As the second planks move under the person, the person would now release the lever from its first or rest position and apply a force to bring the lever toward a second position, this force is carried by the first link into the first disc to cause the first and second disc to rotate and through the third and fourth links simultaneously move the first planks from their parallel position with respect to the first and second members toward a second position that is parallel with the second support and thereby define a seat for the person. The person may hereafter provide a second input signal to the control that reverses the direction of the motor for the hoist to raise the chair off of the fixed surface. When the chair reaches a desired height, the person would supply a third signal to the control for the motor that terminates the actuation of the hoist and switches the motor to the conveyor to move the person from a first location to a second location.

An advantage of the invention is in the ability of a person to independently get into a chair and thereafter control the movement of the chair along a rail to move from a first location to a second location.

The present invention provides a chair that is connected along a center of gravity to a hoist to prevent a person from being dumped onto a surface after being lifted from a first position to a second position during translation along a rail from one location to a second location.

DETAILED DESCRIPTION

In the specification where similar components are used the component may be identified by a number or a same number plus depending on a relationship with other components.

Figures 1, 1A:
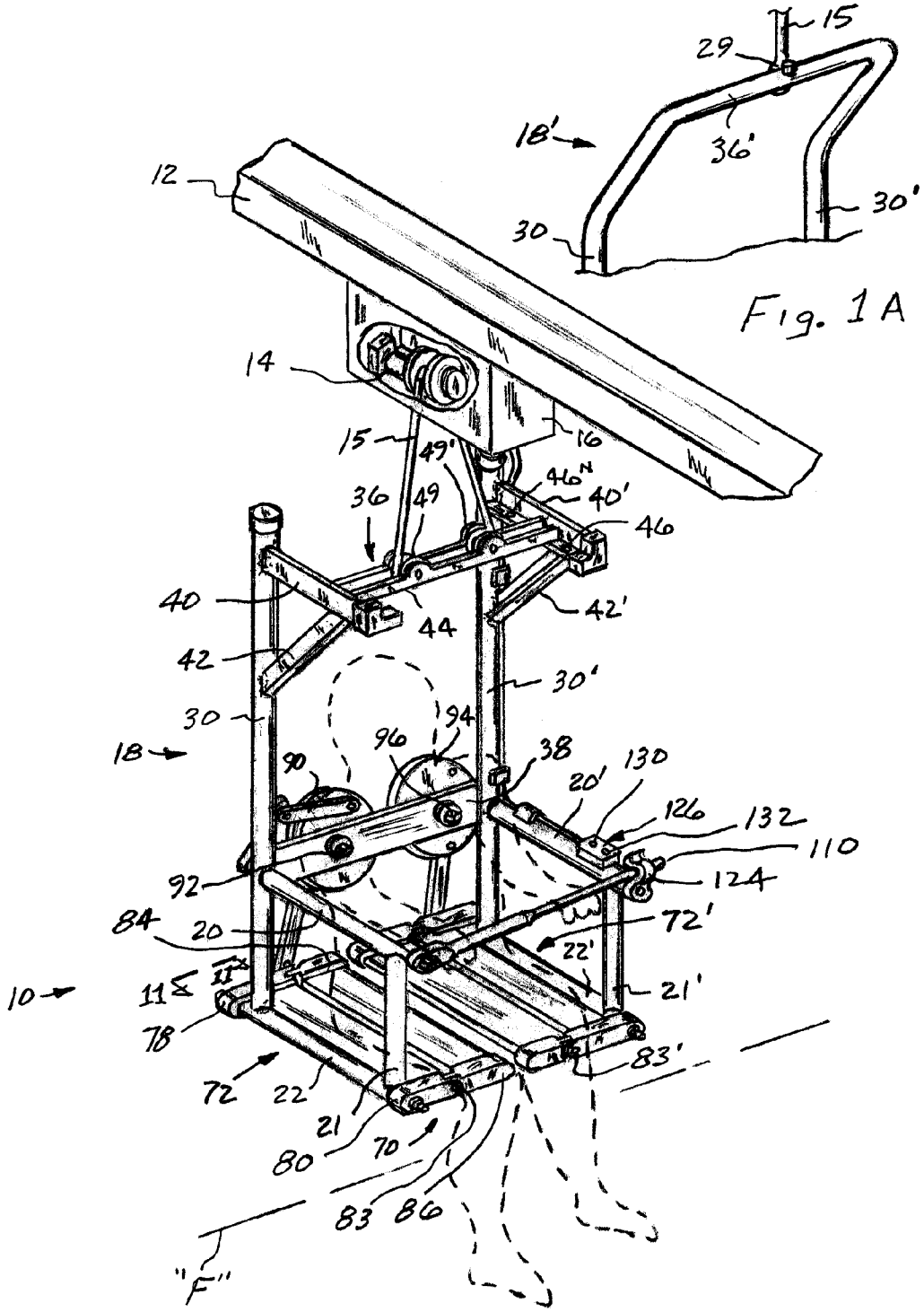
FIG. 1 is a front perspective view of a chair according to the present invention for use in a transport system whereby a person may move from one location to another location.
FIG. 1A is a view of an alternate construction for a back for the chair of FIG. 1 using a continuous tube.

The chair 10 shown in FIG. 1 is made according to the present invention and is fixed to a rail 12 through a hoist 14 and conveyor 16. A motor for operating the hoist 14 and conveyor 16 for moving the chair 10 from a first location to a second location is responsive to an input signal supplied to a control member 126 by a person.

The chair 10 is defined by a back member 18 having a rigid frame, top 20, 20' and bottom 22, 22' arms that extend from the back member 18 and a seat 70. The top of the back member 18 is attached to the hoist 14 such that a person located on seat 70 may be moved from a first horizontal position to a second horizontal position in response to an input signal supplied to the control member 126 to activate the motor associated with the hoist 14 and conveyor 16. The chair 10 is designed such that a person may get onto the seat 70 by manipulation of the seat 70 under his body as the hoist 14 lowers the chair 10 from a first vertical position to a second vertical position with respect to a fixed surface "F" on which the person is located. Once the person is located on the seat 70, the chair 10 is raised from the second vertical position to a new vertical position above the fixed surface F and thereafter an input signal is supplied to the control member 126 to terminate the activation of the motor for the hoist 14 and if desired to activate the motor for the conveyor 16 to move the chair 10 along the rail 12 to another location.

The frame for the back member 18 is shown in more detail in FIGS. 2, 3, 4,5,6,7 and 10 and includes a first member 30 that has a first end 32 and a second end 34 and a second member 30' that has a first end 32' and a second end 34'. The first ends 32, 32' are connected to each other by a first support member 36 while a second support member 38 is located between the first ends 32, 32' and second ends 34, 34' and is fixed to the first member 30 and second 30' member to form a rigid structure with the first member 30 being located in parallel alignment with the second member 30'.

The first support member 36 is made up of a first strap 40 and first brace 42 that extend from the first member 30, a second strap 40' and second brace 42' that extend from the second member 30' and a cross strap 44 that is fixed to the first straps 40, 40'. The first strap 40 and the second strap 40' each have a plurality of holes 46, 46'—46' located thereon and by selectively choosing a hole 46, 46'—46" it is possible to locate a center of gravity for the chair 10 thereon. The cross strap 44 has wheels or sheaves 49, 49' that receive a cable 15 from hoist 14 to provide for vertical movement of the chair 10 by the actuation of the motor for hoist 14.

In some instance it may be desirable to make a back member 18' from a continuous tube as illustrated in FIG. 1A. In such a back member 18' the first support member 36' is would be offset from the first side member 30 and second side member 30' a distance such that the center of gravity is located by eye hook 29 that is connected to a sheave for cable 15 for hoist 14.

The first top arm 20 and the first bottom arm 22 are fixed to the first member 30 in a plane that is perpendicular to the second support member 38 and parallel to the first strap 40 of the first support member 36 and to each other by a tube 21 while second top arm 20' and the second bottom arm 22' are fixed to the second member 30' In a plane that is perpendicular to the second support member 38' and parallel to the first strap 40' of the first support member 36' and to each other by a tube 21'.

Figure 10:
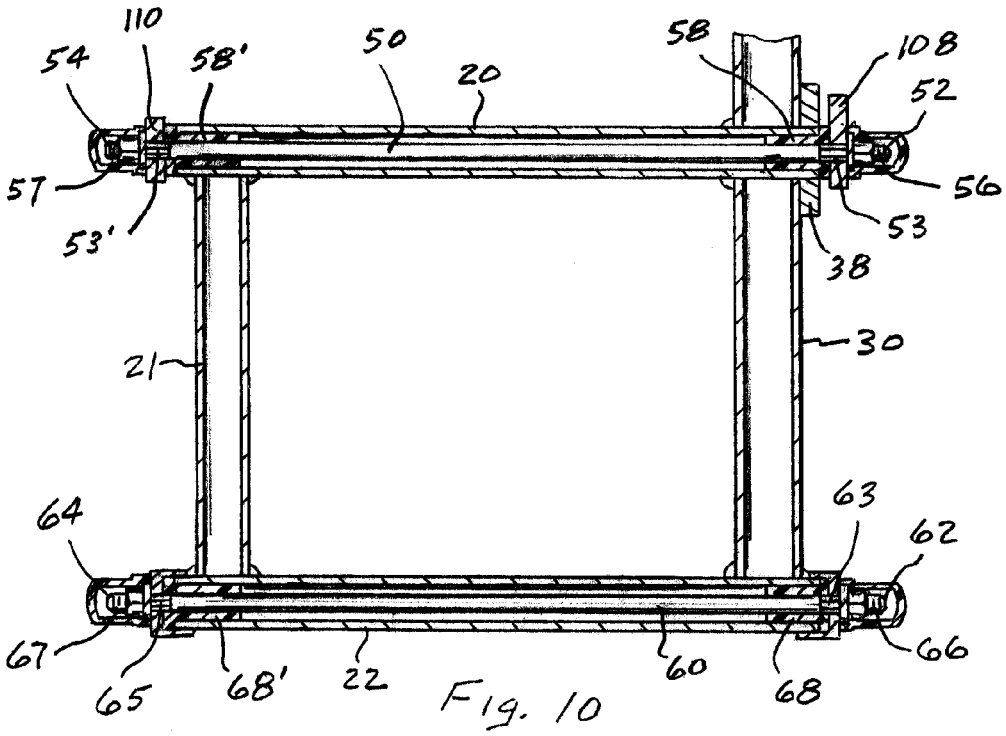
FIG. 10 is a sectional view taken along lines 10—10 of FIG. 6.
Figure 12:
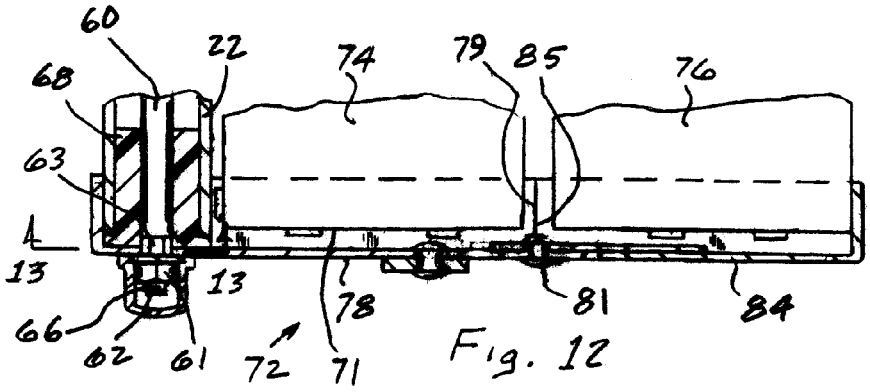
FIG. 12 is a sectional view taken along lines 12—12 of FIG. 11.
Figure 11:
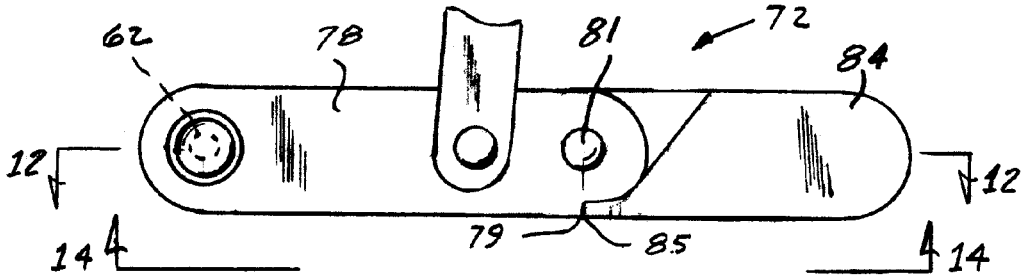
FIG. 11 is a view taken along lines 11—11 of FIG. 1.
Figure 14:
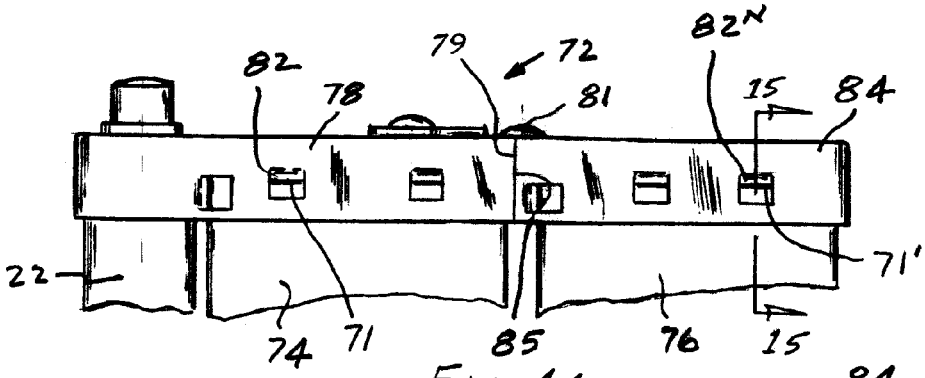
FIG. 14 is a view taken along lines 14—14 of FIG. 11.
Figure 13:
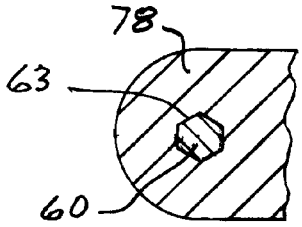
FIG. 13 is a sectional view taken along lines 13—13 of FIG. 12.
Figure 15:
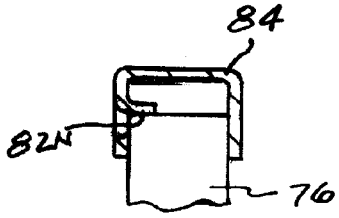
FIG. 15 is a sectional view taken along lines 15—15 of FIG. 14.

A first or lever shaft 50 has a first end 52 that extends through the first member 30 and a second end 54 that extends through the first top arm 20 as shown in FIG. 10. The first end 52 has an irregular or knurled surface 53 located adjacent threads 56 while end 54 also has an irregular or knurled surface 53' located adjacent threads 57. Bearings 58, 58' are located in the first top arm 20 to allow the shaft 50 to freely rotate with respect to the first top arm 20.

A second or seat shaft 60 has a first end 62 that extends through the first member 30 and a second end 64 that extends through the first bottom arm 22 as shown in FIG. 10. The first end 62 has an irregular or knurled surface 63 located adjacent threads 66 while the second end 64 also has an irregular surface 65 located adjacent threads 67. Bearings 68, 68' are located in the first bottom arm 22 to allow the shaft 60 to freely rotate with respect to the first bottom arm 22.

A third or seat shaft 60', that is identical to seat shaft 60, is located in the second bottom arm 22' and has a first end 62' that extends through the second member 30' and a second end 64' that extends through the second bottom arm 22'. The first end 62' has an irregular or knurled surface 63' located adjacent threads 66' while the second end 64' also has an irregular surface 65' located adjacent threads 67'. Bearings (68, 68' not shown) are located in the second bottom arm 22' to allow the shaft 60' to freely rotate with respect to the second bottom arm 22.

The seat 70 as shown in FIG. 1 is made up of an identical first section 72 and a second section 72', with the first section 72 shown in more detail in FIGS. 11, 12, 13, 14 and 15. Each section 72, 72' has a first plank 74, 74' and a second plank 76, 76'. The first plank 74 is located between a first bracket 78 and a second bracket 80 whose ends are respectively attached to the irregular or knurled sections 63, 65 on shaft 60 and retained thereon by nuts 61, 61' that are respectively attached to threads 66, 67. Tabs 82, 82'—82" are located on the first 78 and second 80 brackets and engage the ends 71 (only end 71 is shown) to position the first plank 74 adjacent the first bottom arm 22. A third bracket 84 is pivotally attached to the first bracket 78 by a pin 81 while a fourth bracket 86 that retains the second plank 74 is pivotally attached to the second bracket 80 by pin 83. The third bracket 84 has a face 85 thereon and the fourth bracket 86 has an identical face thereon (not shown) that extends there from and that respectively engage a face 79 on the first bracket 78 and a face (not shown) on the second bracket 80 to limit the pivotal rotation of the third 84 and fourth brackets 96 with respect to the first bracket 78 and second bracket 80.

Figure 2:
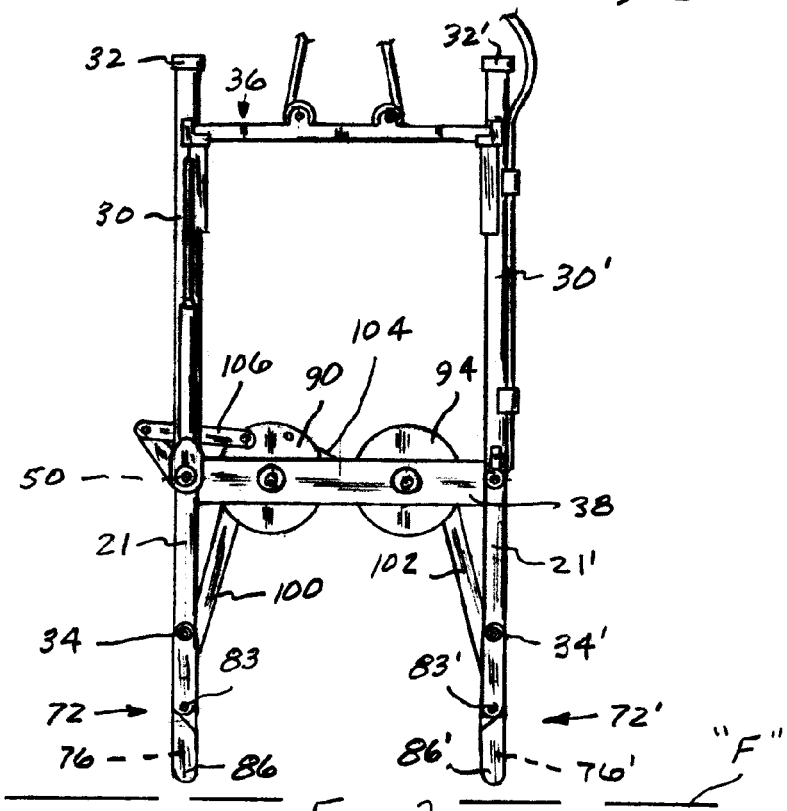
FIG. 2 is a front view of the chair of FIG. 1 in a first position above a horizontal surface.
Figure 5:
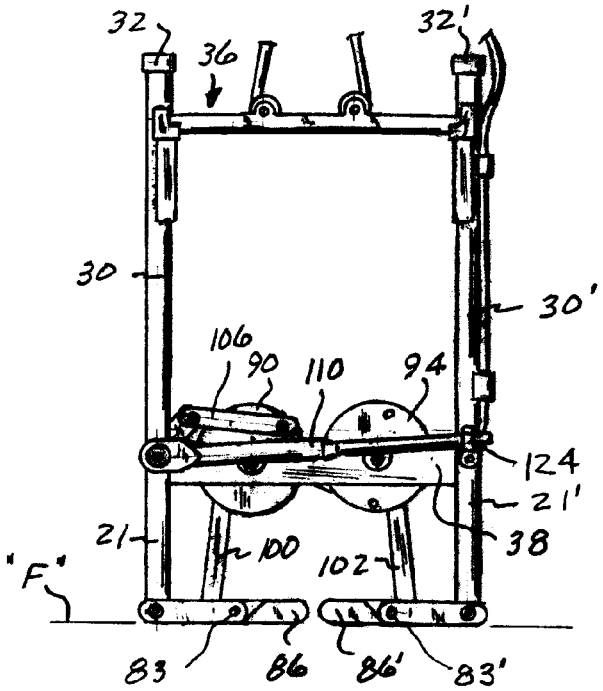
FIG. 5 is front elevation view of the chair of FIG. 4 when the chair is positioned on the horizontal surface.
Figure 7:
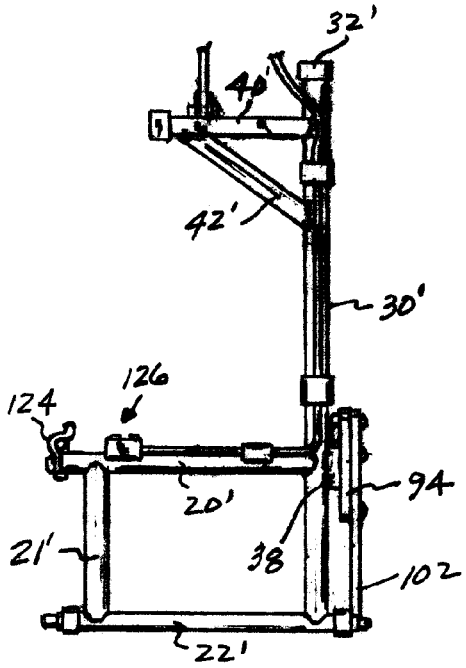
FIG. 7 is side elevation view of the chair of FIG. 5.

A first disc 90 is pivotally attached to the second support member 38 by pin 92 while a second disc 94 is attached to the second support member 38 by a pin 96. Disc 90 is connected to shaft 50 through a linkage arrangement that includes a first strap 100 that is attached to bracket 78 while disc 94 is connected to shaft 60' by a second strap 102 that is attached to bracket 78'. The first disc 90 is connected to the second disc 94 by a strap 104 and to a lever 110 through a strap 106 that is connected to arm 108 that is affixed on knurled surface 53 on end 52 of shaft 50. Lever 110 is affixed to the knurled surface 53' to the end 54 of shaft 50 and when positioned in an opened or first position is substantially located in parallel alignment with the first member 30, as shown in FIG. 2 while in a closed or second position is substantially located in parallel alignment with the second support member 38 as shown in FIG. 5.

Figure 8:
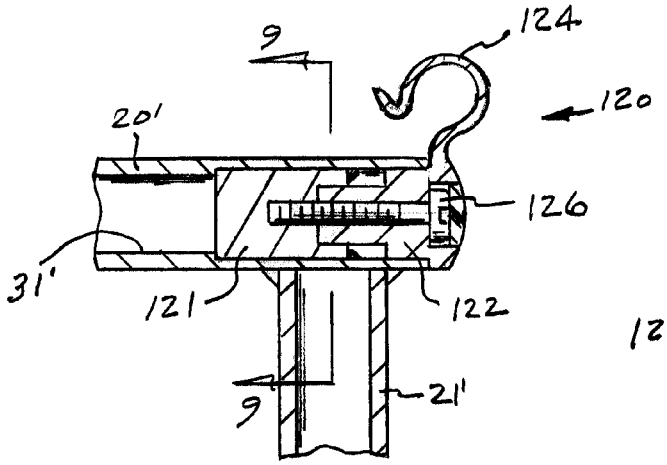
FIG. 8 is a sectional view taken along lines 8—8 of FIG. 3.
Figure 9:
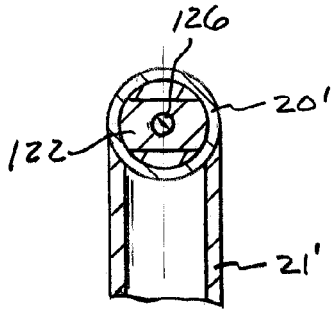
FIG. 9 is a sectional view taken along lines 9—9 of FIG. 8.

The lever 110 is retained in the closed position by a lock arrangement 120, see FIGS. 8 and 9, that is attached to the second top arm 20' that extends from member 30'. The lock arrangement 120 includes a plug 121 that is inserted into bore 31' of the second top arm 20', a body 122 with a hook 124 that projects there from and a screw 126. Screw 126 extends through the body 122 and engages and expands the plug 121 to fix the lock arrangement 120 to the second top arm 20'.

The control member 126 controls the operation of the motor for the hoist 14 and conveyor 16 and is located on second top arm 20'. The control member 126 includes a first input member 130 for hoist 14 and a second input member 132 for conveyor 16. The control member 126 is designed such that simultaneous activation of the motor for the hoist 14 and conveyor 16 will not occur should a person attempt to provide an input signal to both the first 130 and second 132 input members.

Mode of Operation of the Invention

Figure 4:
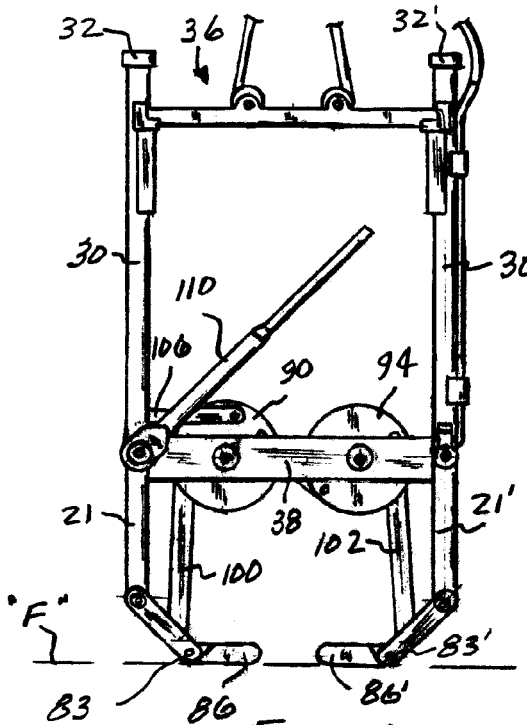
FIG. 4 is a front view of the chair of FIG. 3 when the chair has moved closer to the horizontal surface.
Figure 3:
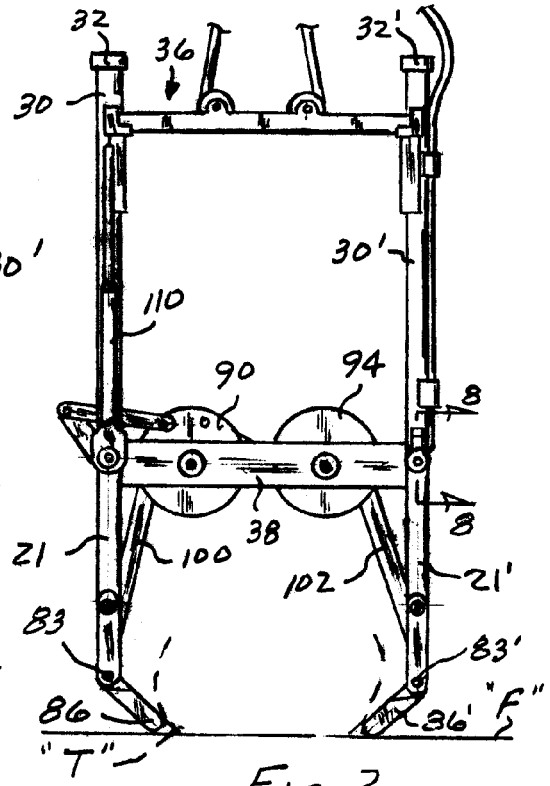
FIG. 3 is a front view of the chair of FIG. 2 on an initial engagement of planks in a seat with the horizontal surface.
Figure 6:
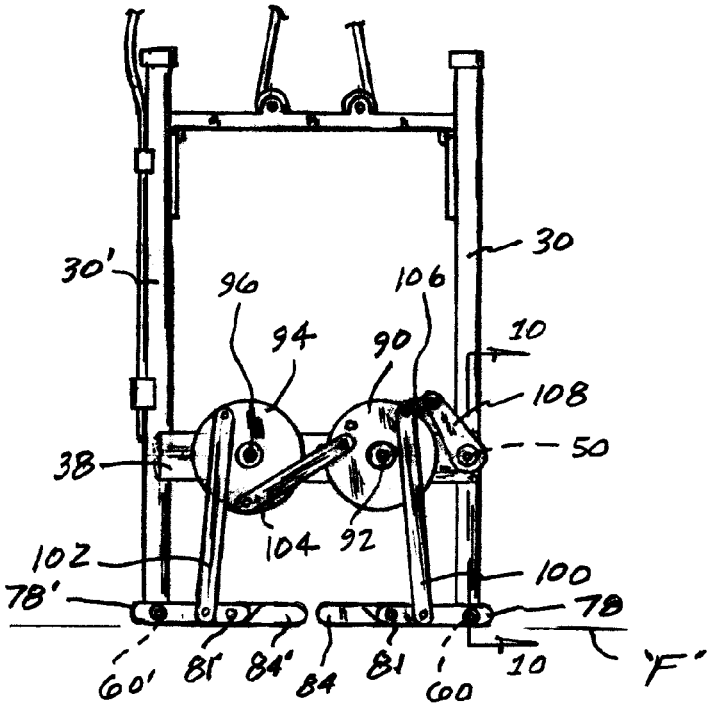
FIG. 6 is a rear elevation view of the chair of FIG. 5.

When a person desires to enter the chair 10, a remote control activates the motor for the hoist 14 and/or the conveyor 16 to bring the chair 10 to a position over the person. Initially the chair 10 is in a ready or rest position as illustrated in FIG. 2 where the first 72 and second 72' portions that make up seat 70 are respectively aligned in planes with the first member 30 and second member 30'. The signal for the motor for the hoist 14 is activated and the chair 10 is lowered from a first position toward a fixed surface "F" such that when the second planks 76, 76' engage the fixed surface "F", the brackets 84, 86 and 84' 86' respectively pivot on pins 81, 83, and 81' 83' in a manner as illustrated in FIG. 3 and move toward each other and under the torso T of a person sitting on the fixed surface F. At the time that the brackets 84, 86, and 84', 86' begin to pivot, the person may would release the lever 110 from its position of rest to assist in the movement of the second planks 76, 76' under his torso. As the person moves the lever 110 from its rest or first position, a rotary torque is imparted into lever shaft 50 that is communicated through strap 106 to rotate disc 90 and through strap 104 to rotate disc 94. Rotation of disc 90 causes strap 100 to pull on and move bracket 78 while rotation of disc 94 causes strap 102 to pull on and move bracket 78' in a manner as illustrated in FIG. 4. When the chair 10 engages the fixed surface "F", the lever 110 will have been moved to a position that is substantially parallel with the second support member 38 and disc 90 and 94 will assume a position as illustrated in FIGS. 5 and 6. Once end 111 of lever 10 is moved into hook 124 to lock the lever 110 in the position as illustrated in FIG. 5, a person may thereafter supply the control member 126 with a second signal to reverse the direction of the motor such that the hoist 14 now moves the chair 10 from this position on the fixed surface "F" to a second position above the fixed surface "F". A person may now push input member 126 of the control member 126 to activate the motor for the conveyor 16 and translate the chair 10 on the rail 12 to a different location.

What is claimed is:

1. A chair for use in a person transporting system having a hoist and motorized conveyor located on a rail whereby the person is vertically lifted from a first location and thereafter horizontally moved from the first location to a second location in response to an input provided by the person, said chair being characterized by:

a frame defined by a first member having a first end and a second end and a second member having a third end and a fourth end, said first end and said third end being connected to each other by a first support member while a second support member located between said first and second ends and said third and fourth ends is fixed to said first member and said second member to form a rigid member with said first member being parallel with said second member;

a first top arm and a first bottom arm attached to said first member in a plane perpendicular to said second support member;

a second top arm and a second bottom arm attached to said second member in a plane perpendicular to said second support member;

a first shaft with a first end that extends through said first member and a second end that extends through said first top arm;

a second shaft with a first end that extends through said first member and a second end that extends through said first bottom arm;

a third shaft with a first end that extends through said second member and a second end that extends through said second bottom arm;

a first plank assembly connected to said second shaft;

a second plank assembly connected to said first plank assembly to define a first portion of a seat;

a third plank assembly connected to said third shaft;

a fourth plank assembly connected to said third plank assembly to define a second portion of the seat;

a first disc attached to said second support member;

a second disc attached to said second support member;

linkage means for connecting said first end of said first shaft with said first disc, for connecting said first disc with said first plank assembly, for connecting said first disc with said second disc, and for connecting said second disc with said third plank assembly;

a lever that is fixed to said second end of said first shaft has a horizontal first position that is substantially with parallel with said first member and a vertical second position that is substantially parallel with said second support member, said lever being moved by the person from said first position to said second position to impart a force into said linkage means that causes said first and second disc to simultaneously rotate and move said first and second plank assemblies and said third and fourth plank assemblies from first positions parallel to said first and second members to a second position parallel with said second support member to define said seat; and fastener means attached to said first support member along a center of gravity for said chair such that on receipt of an input by a controller, the hoist moves the first and second members in parallel planes that are perpendicular to the rail.

2. The chair as recited in claim 1 wherein said second and fourth plank assemblies move independently with respect to said first and third plank assemblies such that with movement of said first and second members by the hoist, the second and fourth plank assemblies initially engage a fixed surface and may move into the second position prior to movement of said lever from said first position.

3. The chair as recited in claim 2 wherein the movement of said lever from said first position to said second position as the hoist moves the first and second members toward the fixed surface aids in the movement of said second and fourth plank assemblies toward said second position.

4. The chair as recited in claim 3 further including a lock arrangement that said lever engages to maintain said first and second and third and fourth plank assemblies in said second position to define the seat.

5. The chair as recited in claim 4 further including a switch that prevents simultaneous actuation of said motorized conveyor and said hoist.

6. The chair as recited in claim 5 wherein said second and fourth plank assemblies includes brackets that respectively engage said first and third plank assemblies to limit the independent movement thereof.

7. The chair as recited in claim 6 wherein said linkage means includes a first strap through which said first disc is connected with said first plank assembly and a second strap through which said second disc is connected with said third plank assembly, said first strap and said second strap being aligned in substantially parallel planes with said first and second members when said lever is located in said second position.

8. The chair as recited in claim 7 wherein said linkage means further includes a third strap for connecting said first disc with said second disc, said third strap being located along an incline such that said first and third plank assemblies simultaneously move in unison from said first position to said second position.

9. The chair as recited in claim 8 wherein said fastener means is adjustable with respect to said first support member to define said center of gravity for said chair.

10. The chair as recited in claim 9 wherein said first and third ends of said first member and second members are offset with respect to a section thereof that forms a back for said chair.

* * * * *